US005477314A

United States Patent [19]

Tsuchiya et al.

[11] Patent Number: 5,477,314

[45] Date of Patent: Dec. 19, 1995

[54] SHEET CONVEYING APPARATUS WITH GUIDE MEMBER

[75] Inventors: Hiroaki Tsuchiya; Tetsuro Tomoe; Osamu Yoshimura; Masami Fuchi; Shinichi Tanaka; Keiji Ban, all of Osaka, Japan

[73] Assignee: Mita Industrial Co., Ltd., Osaka, Japan

[21] Appl. No.: 272,737

[22] Filed: Jul. 11, 1994

[30] Foreign Application Priority Data

Jul. 29, 1993 [JP] Japan ..... 5-187938

[51] Int. Cl.[6] ..... G03G 15/14

[52] U.S. Cl. ..... 355/271; 355/308

[58] Field of Search ..... 355/271, 273, 355/274, 276, 282, 284, 285, 290, 308, 309

[56] References Cited

U.S. PATENT DOCUMENTS 4,939,550 7/1990 Takada et al. ..... 355/282

5,159,391 10/1992 Koshi et al. ..... 355/271

5,166,737 11/1992 Tomita ..... 355/308

5,189,479 2/1993 Matsuda et al. ..... 355/274

5,285,245 2/1994 Goto et al. ..... 355/271

*Primary Examiner*—William J. Royer

*Attorney, Agent, or Firm*—Beveridge, DeGrandi, Weilacher & Young

[57] ABSTRACT

An apparatus for conveying sheet members, equipped with a conveyer guide member that extends from the downstream side of a toner image-transfer position of a photosensitive drum toward a fixing unit and a grounding plate member that is disposed on the lower surface side of the conveyer guide member. The conveyer guide member is made of a material having an electric resistance not smaller than the electric resistance of the sheet member, and the grounding plate member is made of a material having an electric resistance smaller than the electric resistance of the conveyer guide member.

16 Claims, 4 Drawing Sheets

SHEET CONVEYING APPARATUS WITH GUIDE MEMBER

FIELD OF THE INVENTION

The present invention relates to an apparatus for conveying sheet members in an image-forming machine such as an electrostatic copying machine, a facsimile or a printer and, particularly, to an apparatus for conveying sheet members in which a conveyer guide member is disposed on the downstream side of a toner image-transfer position of a photosensitive drum.

DESCRIPTION OF THE PRIOR ART

There has heretofore been known and put into practical use an apparatus for conveying sheet members equipped with a conveyer guide member inclusive of a guide portion that extends from the downstream side of a toner image-transfer position of a photosensitive drum toward a fixing unit. The guide portion of the conveyer guide member is so constituted as to guide a sheet member that is conveyed through the toner image-transfer position, toward the fixing unit along the upper surface thereof. Here, the apparatus for conveying sheet members must simultaneously satisfy the following three requirements in a step in which a sheet member onto which the toner has been transferred at the toner image-transfer position is being conveyed to the fixing unit via the conveyer guide member.

(1) The sheet member to which the toner image has been transferred must be reliably separated from the surface of the photosensitive drum without being taken up by the photosensitive drum (excellent separating performance).

(2) The sheet member separated from the surface of the photosensitive drum must be smoothly and reliably conveyed along the upper surface of the guide portion without floating on the upper surface of the guide portion of the conveyer guide member (excellent conveying performance).

(3) A vivid image must be guaranteed after fixing without permitting the toner transferred onto the sheet member to be scattered.

A conveyer guide member made of an ABS resin has heretofore been used in the conventional apparatus for conveying sheet members. The conveyer guide member has a function for mechanically guiding the sheet member onto which the toner has been transferred to the fixing unit as well as a function for releasing excess electric charge imparted to the sheet member when the toner is transferred thereon. The conveyer guide member is provided with the latter function in order to improve the above-mentioned separating performance and conveying performance, as well as to prevent the occurrence of toner scattering. Here, when the electric charge imparted to the sheet member abruptly migrates to the conveyer guide member, toner scattering tends to occur. Moreover, when the conveyer guide member is excessively charged with the electric charge from the sheet member, the separating performance and conveying performance are impaired. Such a tendency varies depending upon the electric resistance of the conveyer guide member. In the conventional apparatus for conveying sheet members, therefore, the above-mentioned conflicting problems have been solved by appropriately selecting the electric resistance of the conveyer guide member. However, the conventional means for solving the problems is not capable of simultaneously satisfying the above-mentioned three conditions.

SUMMARY OF THE INVENTION

The object of the present invention is to provide an improved apparatus for conveying sheet members which features excellent performances for separating and conveying the sheet members after the toner has been transferred thereon and which does not permit toner scattering to occur on the sheet members.

According to one aspect of the present invention, there is provided an apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position toward said fixing unit along the upper surface thereof, wherein a grounding plate member is disposed on the lower surface side of said guide portion of said conveyer guide member so as to extend along said guide portion, said conveyer guide member is made of a material having an electric resistance not smaller than the electric resistance of said sheet member, and said grounding plate member is made of a material having an electric resistance smaller than said electric resistance of said conveyer guide member.

According to another aspect of the present invention, there is provided an apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position toward said fixing unit along the upper surface thereof, wherein a grounding plate member is disposed on the lower surface side of said guide portion of said conveyer guide member so as to extend along said guide portion and to come with the upper surface thereof into contact with the lower surface of said guide portion, said conveyer guide member is made of a material having an electric resistance of from $10^{13}$ Ω to $10^{16}$ Ω which is not smaller than the electric resistance of said sheet member, and said grounding plate member is made of a metal material having an electric resistance of not larger than $10^{3}$ Ω.

According to a further aspect of the present invention, there is provided an apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position, toward said fixing unit along the upper surface thereof, wherein an insulating member is disposed above said guide portion while maintaining a distance with respect to, and extending along, said guide portion.

In the apparatus for conveying sheet members according to the present invention, the grounding plate member is disposed on the lower surface side of the guide portion of the conveyer guide member so as to extend along the guide portion. The conveyer guide member is made of a material having an electric resistance not smaller than the electric resistance of the sheet member. The grounding plate member is made of a material having an electric resistance smaller than the electric resistance of the conveyer guide member.

A high voltage (transfer voltage) is applied to the sheet member that is sent to the toner image-transfer position of the photosensitive drum so that the toner is transferred thereon. With the movement of the sheet member, excess of electric charge imparted to the sheet member by applying the transfer voltage migrates to the surface of the guide portion. However, since the transfer guide member has an electric resistance not smaller than the electric resistance of the sheet member, the electric charge is suppressed from abruptly migrating. As a result, the toner on the sheet member is prevented from scattering at the time when the sheet member comes into contact with the surface of the guide portion, and hence, a vivid image is guaranteed.

Moreover, the grounding plate member having the electric resistance smaller than the electric resistance of the conveyer guide member is disposed on the lower surface side of the guide portion of the conveyer guide member and, hence, the electric charge that has migrated from the sheet member to the surface of the guide portion is partly discharged by the function of the grounding plate member. That is, the surface of the guide portion is prevented from being excessively charged with the electric charge from the sheet member. As a result, the sheet member is not repelled by the conveyer guide member, making it possible to improve performance for separating the sheet member from the photosensitive drum and for conveying the sheet member along the guide portion. Moreover, while the sheet member is moving along the surface of the guide portion, excess electric charge on the sheet member is gradually discharged while a relation "potential of the sheet member > potential on the surface of the guide portion" being maintained. Therefore, the toner on the sheet member is reliably prevented from scattering while the sheet member is moving along the surface of the guide member or when the sheet member separated from the guide portion comes into contact with a metal portion (guide plate, heat roller, etc.) of the fixing unit.

When the grounding plate member is disposed with its upper surface in contact with the lower surface of the guide portion, the dielectric effect becomes high between the lower surface of the guide portion and the upper surface of the grounding plate member, making it possible to more reliably prevent the sheet member side from being excessively charged.

When the grounding plate member is made of a metal material, the sheet member is attracted more effectively; i.e., the sheet member is not taken up by the photosensitive drum, making it possible to obtain improved separating performance and stabilized conveying performance.

When the grounding plate member is grounded, an improved discharging function is obtained, making it possible to further reliably prevent the above-mentioned excess of charging.

When a plurality of openings are formed in the guide portion and the upper surface of the grounding plate member is exposed to the upper surface side of the guide portion through the openings, the sheet member is attracted more strongly, making it possible to obtain further increased separating performance and further stabilized conveying performance.

When there are formed, on at least the upstream end portion of the guide portion, a plurality of ribs that are protruded upwardly, are extended in the direction of conveying the sheet member and are arranged, spaced from each other, in a direction at right angles with the conveying direction, the electrostatic repulsion between the sheet member and the surface of the guide member is decreased and the separating performance is improved even when the sheet member comes close to, or in contact with, the guide portion, i.e., the ribs. When the ribs are formed in addition to the above plurality of openings, the aforementioned effects are obtained and, besides, the sheet member can be smoothly conveyed without coming into contact with the grounding plate member through the openings. Moreover, the electric charge of the sheet member is prevented from leaking to the grounding plate member. Since the contacting portion decreases between the sheet member and the guide portion, the repulsion due to the migration of electric charge decreases and the sheet member is favorably separated. Furthermore, when the ribs are so formed that they become high toward the upstream side and low toward the downstream side, the sheet member can be stably conveyed on the downstream side. That is, the electric charge of the sheet member tends to decrease as it moves toward the downstream of the guide portion and the attractive force by the grounding plate member tends to decrease. However, since the distance is shortened between the sheet member and the grounding plate member on the downstream side, a suitable attractive force can be maintained.

When the insulating member is disposed above the guide portion while maintaining a distance with respect to, and extending along, the guide portion, the insulating member is electrically charged to the same polarity as that of the electric charge of the sheet member and hence, a repulsion is produced between the two. As a result, performance for separating the sheet member is particularly enhanced and conveying performance is stabilized. The above-mentioned effects are obtained even when the grounding plate member is not disposed on the lower surface side of the guide portion. Besides, the toner is prevented from scattering. This is because the presence of the insulating member suppresses abrupt migration of the electric charge from the sheet member to the conveyer guide member. When a sheet member guide plate is disposed above the guide portion while maintaining a distance with respect to, and extending along, the guide portion and when an insulating member made of an insulating film is stuck to the lower surface that is facing the guide portion, of the sheet member guide plate, there is no need of providing any particular support means for mounting the insulating member and hence, the cost can be decreased.

DETAILED DESCRIPTION OF THE PREFERRED EMBODIMENTS

Figure 1:
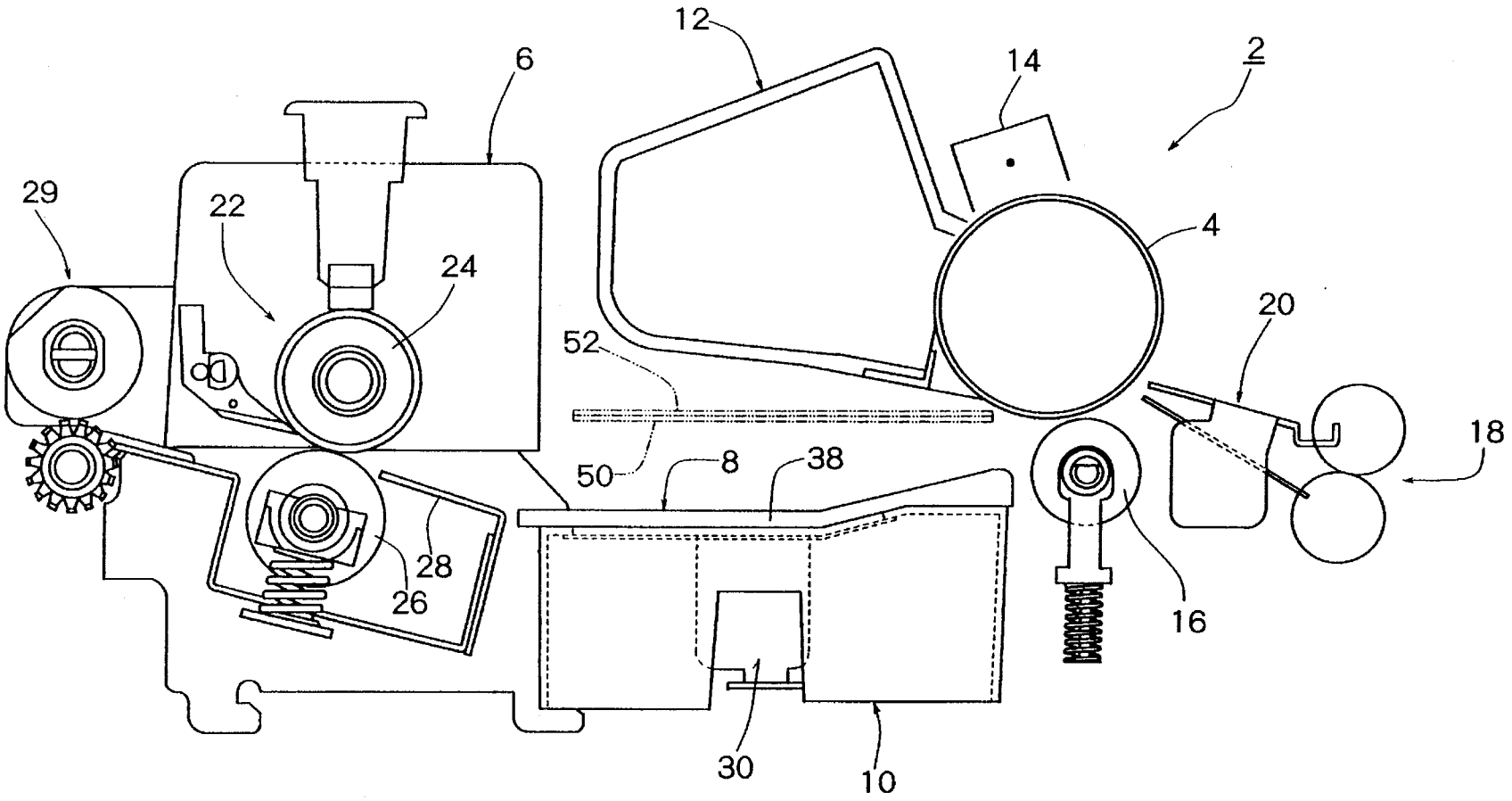
FIG. 1 is a side view which schematically illustrates an embodiment of an apparatus for conveying sheet members improved according to the present invention.

The apparatus for conveying sheet members improved according to the present invention will now be described in detail by way of an embodiment which is adapted to a printer with reference to the accompanying drawings. Referring to FIG. 1, an apparatus 2 for conveying sheet members is equipped with a conveyer guide member 10 including a guide portion 8 that extends from the downstream side of a toner image-transfer position of a photosensitive drum 4 toward a fixing unit 6. The photosensitive drum 4 is surrounded by a cleaning unit 12, a charging unit 14, an exposing unit and a developing unit that are not illustrated, and a transfer roller 16 that are arranged in a manner known among people skilled in the art. The transfer roller 16 is disposed at the toner image-transfer position of the photosensitive drum 4. A pair of resist rollers 18 are disposed on the upstream side of the toner image-transfer position, and a pair of guide plates 20 are arranged on the downstream side of the pair of resist rollers 18. The fixing unit 6 includes a pair of fixing rollers 22 that are constituted by a heat roller 24 and a press roller 26. The conveyer guide member 10 is disposed between the toner image-transfer position of the photosensitive drum 4 and the fixing unit 6, and a guide plate 28 is disposed between the conveyer guide member 10 and the pair of fixing rollers 22. A pair of discharge rollers 29 are disposed on the downstream side of the pair of fixing rollers 22. The guide portion 8 of the conveyer guide member 10 is so constituted as to guide the sheet member, in this embodiment, a plain paper (copying paper) that is conveyed passing through the toner image-transfer position toward the fixing unit along the upper surface thereof.

Figure 2:
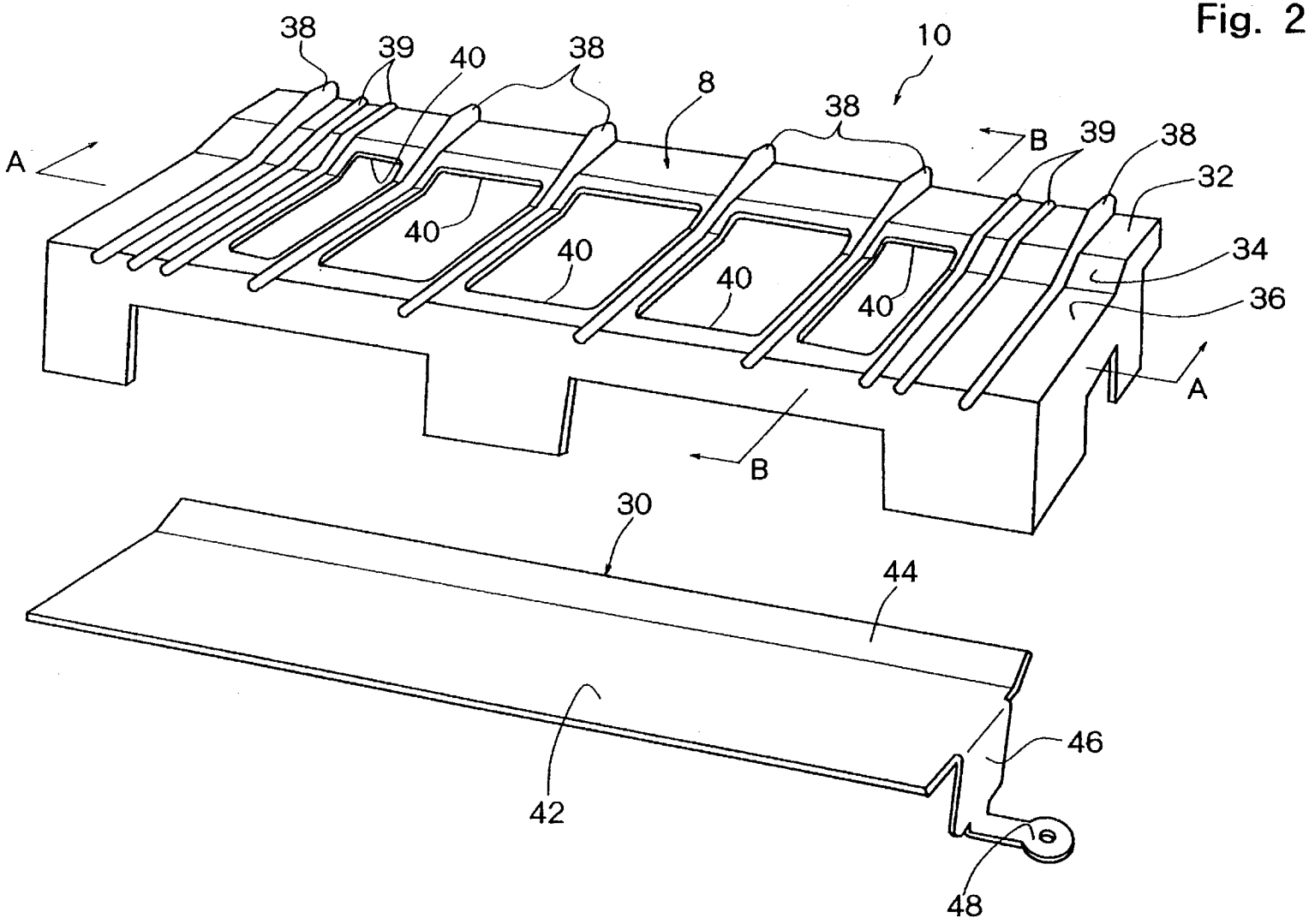
FIG. 2 is a perspective view which schematically illustrates, in a disassembled manner, a conveyer guide member and a grounding plate member included in the apparatus for conveying sheet member of FIG. 1.

A grounding plate member 30 is disposed on the lower surface side of the guide portion 8 and extends along the guide portion 8. The conveyer guide member 10 is made of a material having an electric resistance not smaller than the electric resistance of the plain paper and the grounding plate member 30 is made of a material having an electric resistance smaller than the electric resistance of the conveyer guide member 10. Referring to FIG. 1 as well as FIGS. 2 to 4, the conveyer guide member 10 is molded as a unitary structure using an ABS resin having an electric resistance of from $10^{13}$ Ω to $10^{16}$ Ω ($10^{13}$ Ω in this embodiment) which is not smaller than the electric resistance of the plain paper (generally from $10^{11}$ Ω to $10^{13}$ Ω, but $10^{13}$ Ω in this embodiment), and has substantially a rectangular box-like shape. The upper portion of the conveyer guide member 10 constitutes the guide portion 8, and downwardly extending side walls are formed from the four side edges thereof as a unitary structure. The guide portion 8 includes a horizontal portion 32 that extends from the upstream end thereof (right end in FIGS. 1 and 4) toward the downstream direction (leftwards in FIGS. 1 and 4), a tilted portion 34 that downwardly extends from the downstream end of the horizontal portion 32 toward the downstream direction, and a horizontal portion 36 that extends from the downstream end of the tilted portion 34 up to the downstream end. On the guide portion 8 are formed a plurality of ribs 38 that upwardly protrude and extend in the direction in which the plain paper is conveyed (in the direction from the right toward the left in FIGS. 1 and 4) and are arranged spaced from each other in a direction (right-and-left direction in FIG. 3) at right angles with the conveying direction. The ribs 38 are so formed that they become high toward the upstream side and low toward the downstream side. If described more closely, the ribs 38 have the same height on the horizontal portion 36 and on the tilted portion 34 but are so tilted on the horizontal portion 32 as to become high toward the upstream end and low toward the downstream end. As shown in FIG. 2, furthermore, there are formed a plurality of ribs 39 in addition to the ribs 38. The ribs 39 have the same height on the upstream side and on the downstream side, and the plain paper on the upstream side is guided substantially by the ribs 38. The expression "the ribs have height that becomes high toward the upstream side and low toward the downstream side" encompasses the above-mentioned constitution. A plurality of openings 40 are formed in the guide portion 8 at portions excluding the positions where the ribs 38 and 39 are formed. The openings 40 are substantially of a rectangular shape and are formed spanning across the horizontal portion 36 and the tilted portion 34. In this embodiment, the total area of the openings 40 is set to be more than one-half the area of the guide portion 8. In this embodiment, as will be apparent from FIG. 4, the grounding plate member 30 that will be mentioned later is not positioned under the lower surface of the horizontal portion 32 at the upstream end of the conveyer guide member 10.

The grounding plate member 30 is made of a zinc-plated steel plate (SECC-C specified under JIS) having an electric resistance smaller than $10^{13}$ Ω (and having an electric resistance of $10^{3}$ Ω in this embodiment). The grounding plate member 30 may be made of other metal materials or may be made of, for example, an ABS resin having an electric resistance of from $10^{7}$ to $10^{12}$ Ω. According to this embodiment as will be apparent from FIGS. 3 and 4, the grounding plate member 30 is disposed with its upper surface in intimate contact with the lower surface of the guide portion 8, or more concretely, with its upper surface in intimate contact with the lower surfaces of the horizontal portion 36 and tilted portion 34 of the guide portion 8. That is, the grounding plate member 30 is formed substantially in a rectangular shape and has a horizontal portion 42 and a tilted portion 44. At one side edge of the horizontal portion 42 is integrally formed a side plate 46 that downwardly extends and a grounding portion 48 that is outwardly bent in the horizontal direction at the lower end of the side plate 46. The grounding plate member 30 is so mounted that the upper surface of the horizontal portion 42 is in contact with the lower surface of the horizontal portion 36 of the guide portion 8 and the upper surface of the tilted portion 44 is in contact with the lower surface of the tilted portion 34 of the guide portion 8. The drawings do not illustrate the constitutions of their mounting portions. The grounding plate member 30 may be disposed close to the guide portion 8 but is desirably disposed in contact with, and particularly, in intimate contact with, the guide portion 8. The grounding portion 48 of the grounding plate member 30 is mounted on a horizontal substrate that is not shown on the printer. The grounding plate member 30 is thus grounded. Here, the grounding plate member 30 needs not necessarily be grounded but should desirably be grounded. In a state in which the grounding plate member 30 is mounted on the lower surface of the guide portion 8, the upper surface of the grounding plate member 30 is exposed to the upper surface side of the guide portion 8 through openings 40 in the guide portion 8. In the aforementioned constitution, the guide portion 8 may often be provided with neither the openings 40 nor one or both of the ribs 38 and 39.

Figure 3:
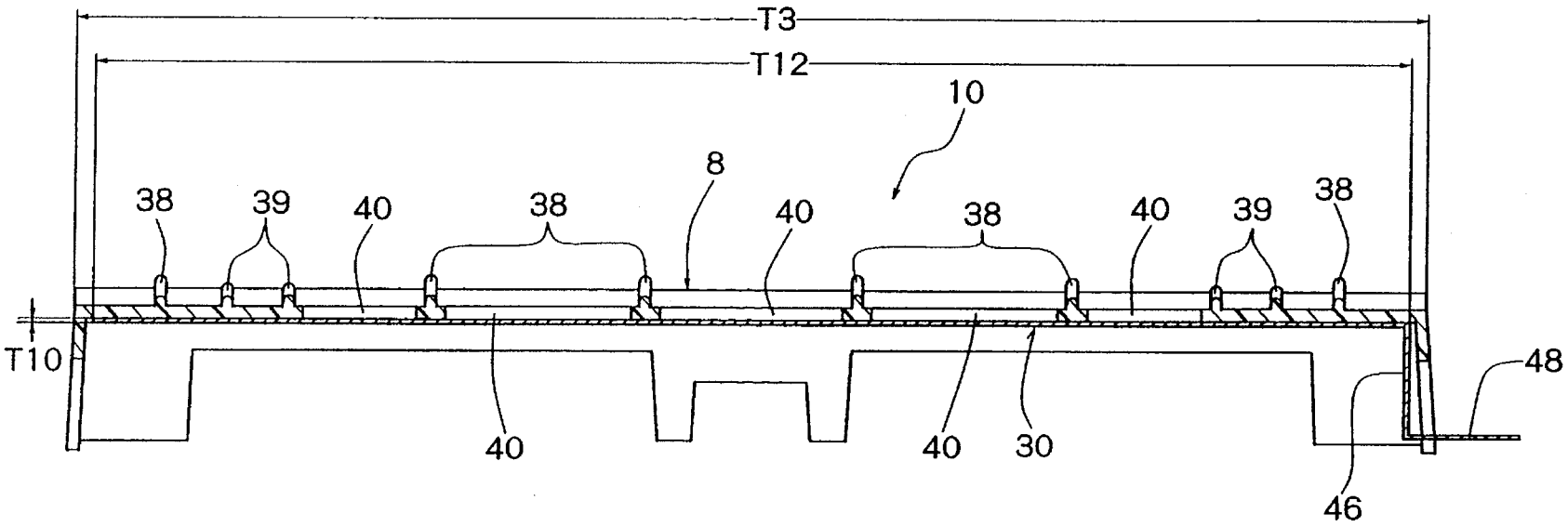
FIG. 3 is a sectional view along the line A—A of FIG. 2.
Figure 4:
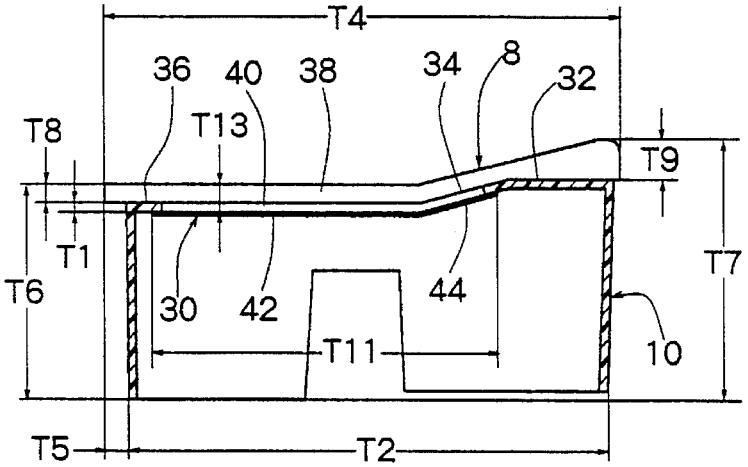
FIG. 4 is a sectional view along the line B—B of FIG. 2.
Figure 5:
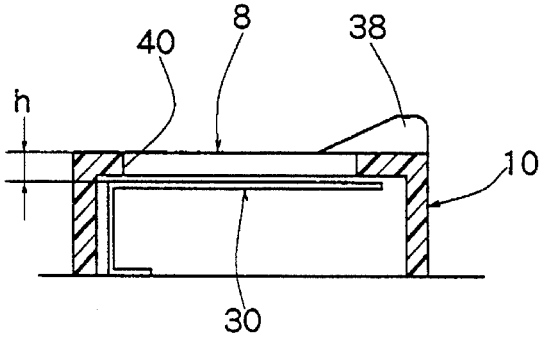
FIG. 5 is a sectional view which schematically illustrates the conveyer guide member embodiment.
Figure 6:
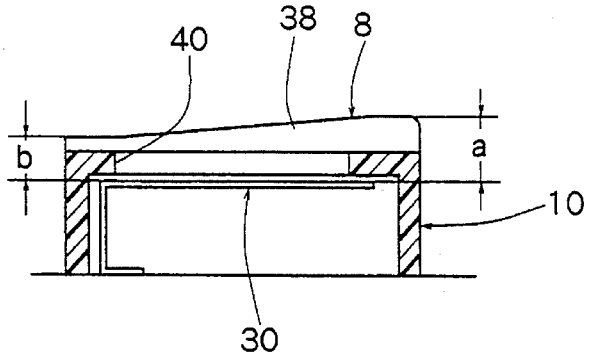
FIG. 6 is a sectional view which schematically illustrates the conveyer guide member and the grounding plate member according to a further embodiment.

FIGS. 5 and 6 schematically illustrate the conveyer guide member 10 and the grounding plate member 30 according to other embodiments, and in FIGS. 5 and 6 the same portions as those of FIGS. 1 to 4 are denoted by the same reference numerals. In FIG. 5, the ribs 38 are formed at the upstream end of the guide portion 8. In FIG. 6, the ribs 38 are formed from the upstream end through up to the downstream end of the guide portion 8 like those shown in FIGS. 1 to 4. The ribs 38 have a height that becomes high toward the upstream side and low toward the downstream side. Here, the distance from the upper surface of the grounding plate member 30 to the vertex of the ribs 38 has been specified to be "upstream side a>downstream side b". In order that the electric charge of the plain paper does not leak to the grounding plate member 30, it is desired that the distance between the vertex of the guide portion 8 and the upper surface of the grounding plate member 30 (distance h in FIG. 5, or distances a and b in FIG. 6) is 3 mm or greater. In FIGS. 5 and 6, the guide portion 8 may not often be provided with either one or both of the openings 40 and the ribs 38.

According to the present invention making reference again to FIG. 1, there is provided an apparatus 2 for conveying sheet members in which an insulating member 50 (see two-dotted chain line) is disposed above the guide portion 8 while maintaining a distance with respect to, and extending along, the guide portion 8. The insulating member 50 is constituted by an insulating film or a PET (polyethylene terephthalate) film in this embodiment. A sheet member guide plate 52 (see two-dotted chain line) is disposed above the guide portion 8 while maintaining a distance with respect to, and extending along, the guide portion 8. The insulating member 50 made of an insulating film is stuck to the lower surface that is facing the guide portion, of the sheet member guide plate 52. The insulating member 0 may be disposed simply in combination with a conventional conveyer guide member in addition to the case where it is disposed for the constitution in which are combined the conveyer guide member 10 and the grounding plate member 30 explained in FIGS. 1 to 6.

Briefly described below is a step for forming an image using a printer that includes the thus constituted apparatus 2 for conveying sheet members. A plain paper that is not shown, sent by the pair of resist rollers 18 passes through the pair of guide plates 20 and further passes through the toner image-transfer position of the photosensitive drum 4, i.e., passes between the photosensitive drum 4 and the transfer roller 16 which is applied with a transfer voltage of a polarity opposite to that of the toner developed on the surface of the photosensitive drum 4. The toner developed on the surface of the photosensitive drum 4 is transferred onto the plain paper. By rotations of the photosensitive drum 4 and the transfer roller 16, the plain paper is conveyed toward the downstream direction along the upper surfaces of the ribs 38 and 39 of the guide portion 8 of the conveyer guide member 10. The plain paper is further sent to the pair of fixing rollers 22 along the guide plate 28 of the fixing unit 6. The plain paper after the toner thereon has been fixed is discharged onto a paper-discharge tray that is not shown, by a pair of discharge rollers 29.

Described below is the operation of the portion related to the present invention in the above-mentioned apparatus 2 for conveying sheet members. A high voltage (transfer voltage) is applied to the plain paper sent to the toner image-transfer position of the photosensitive drum 4, so that the toner is transferred thereon. With the movement of the plain paper, the excess of electric charge imparted to the plain paper by applying the transfer voltage migrates onto the surface of the guide portion 8. However, the conveyer guide member 10 has an electric resistance not smaller than the electric resistance of the plain paper, and the electric charge is suppressed from abruptly migrating. This makes it possible to prevent the toner on the plain paper from scattering, i.e., prevents the image from being disturbed at a moment when the plain paper comes into contact with the surface of the guide portion 8, and thus, a vivid image is guaranteed.

Moreover, since the grounding plate member 30 has an electric resistance smaller than the electric resistance of the conveyer guide member 10 disposed on the lower surface side of the guide portion 8, the electric charge that has migrated onto the surface of the guide portion 8 from the plain paper is partly discharged due to the function of the grounding plate member 30. That is, the surface of the guide portion 8 is prevented from being excessively charged with the electric charge from the plain paper. As a result, the plain paper is not repelled by the conveyer guide member 10, and is separated from the photosensitive drum 4 and is conveyed along the guide portion 8 favorably. Furthermore, while the plain paper is being moved along the surface of the guide portion 8, the excess electric charge on the plain paper is gradually discharged while a relation "potential of the plain paper>potential on the surface of the guide portion 8" is maintained. Therefore, the toner on the plain paper is reliably prevented from scattering either while the plain paper is moving along the surface of the guide portion 8 or when the plain paper separated from the guide portion 8 comes into contact with a metal portion (guide plate 28, heat roller 24, etc.) of the fixing unit 6.

Since the grounding plate member 30 is disposed with its upper surface in contact with the lower surface of the guide portion 8, the dielectric effect becomes high between the lower surface of the guide portion 8 and the upper surface of the grounding plate member 30, making it possible to more reliably prevent the plain paper side from being excessively charged. Since the grounding plate member 30 is made of a zinc-plated steel plate which is a metal material, the plain paper is attracted more effectively; i.e., the plain paper is not taken up by the photosensitive drum 4, making it possible to obtain improved separating performance and stabilized conveying performance.

When the grounding plate member 30 is grounded, an improved discharging function is obtained, making it possible to further reliably prevent the above-mentioned excess of charging. Moreover, since a plurality of openings 40 are formed in the guide portion 8 and the upper surface of the grounding plate member 30 is exposed to the upper surface side of the guide portion 8 through the openings 40, the plain paper is attracted more strongly, making it possible to obtain further increased separating performance and further stabilized conveying performance.

Since a plurality of ribs 38 and 39 are formed on the guide portion 8, the electrostatic repulsion between the plain paper and the surface of the guide member 8 is decreased and the separating performance is improved even when the plain paper comes close to, or in contact with, the guide portion 8 and the ribs 38 and 39. When such ribs 38 and 39 are formed in addition to the above plurality of openings 40, the aforementioned effects are obtained and, besides, the plain paper can be smoothly conveyed without coming into contact with the grounding plate member 30 through the openings 40. Moreover, the electric charge of the plain paper is prevented from leaking to the grounding plate member 30. Since the contacting portion decreases between the plain paper and the guide portion 8, the repulsion due to the migration of electric charge decreases and the plain paper is favorably separated. Furthermore, since the ribs 38 are so formed that they become high toward the upstream side and low toward the downstream side, the plain paper can be stably conveyed on the downstream side. That is, the electric charge of the plain paper tends to decrease as it moves toward the downstream side of the guide portion 8 and the attractive force by the grounding plate member 30 tends to decrease. However, since the distance is shortened between the plain paper and the grounding plate member 30 on the downstream side, a suitable attractive force can be maintained.

When the insulating member 50 is disposed above the guide portion 8 while maintaining a distance with respect to, and extending along, the guide portion 8, the insulating member 50 is electrically charged to the same polarity as that of the above electric charge on the plain paper and a repulsion is produced between the two. As a result, performance for separating the plain paper is particularly enhanced and conveying performance is stabilized. The above-mentioned effects are obtained even when the grounding plate member 30 is not disposed on the lower surface side of the guide portion 8. Besides, the toner is prevented from scattering. This is because the presence of the insulating member 50 suppresses abrupt migration of the electric charge from the plain paper to the conveyer guide member 10. When a sheet member guide plate 52 is disposed above the guide portion 8 while maintaining a distance with respect to, and extending along, the guide portion 8 and when an insulating member 50 made of an insulating film is stuck to the lower surface that is facing the guide portion 8, of the sheet member guide plate 52, there is no need of providing any particular support means for mounting the insulating member 50 and hence, the cost can be decreased.

The invention will now be described by way of Examples and Comparative Examples.

EXAMPLE 1

In Example 1, a step of forming an image was executed using a laser printer that is not shown but that is equipped with the apparatus 2 for conveying sheet members of the form shown in FIGS. 1 to 4. Described below is the outline of the steps of forming an image. The surface of the photosensitive drum 4 was uniformly charged to a positive polarity by a charging unit 14. Then, the surface of the photosensitive drum 4 was irradiated with a laser beam based upon image data to be printed and, thus, an electrostatic latent image (negative latent image) was formed. A reversal development system was employed, and the magnetic toner charged with the positive polarity which was the same polarity as the electrostatic latent image was adhered to the latent image and was developed. The developed toner was transferred onto the sheet member that was sent by the pair of resist rollers 18 between the Photosensitive drum 4 and the transfer roller 16. A constant current of 5 μA was applied to the transfer roller 16, and a transfer voltage of −2 to 3 KV was applied at the time of transfer. The sheet member to which the toner had been transferred was conveyed in the downstream direction along the upper surface of the ribs 38 and 39 of the guide portion 8 of the conveyer guide member 10. The sheet member was further sent to the pair of fixing rollers 22 along the guide plates 28 of the fixing unit 6. The sheet member after the toner thereon had been fixed was discharged onto a paper-discharge tray that is not shown by the pair of discharge rollers 29.

As the sheet member, use was made of a plain paper having an electric resistance of $10^{13}$ Ω. The types of the plain papers used will be described later. The conveyer guide member 10 used was made of an ABS resin having an electric resistance of $10^{13}$ Ω. The guide portion 8 of the conveyer guide member 10 had openings 40 and ribs 38 and 39. The grounding plate member 30 used was made of a zinc-plated steel plate (SECC-C) having an electric resistance of $10^{3}$ Ω. The grounding plate member 30 was disposed with its upper surface in contact with the lower surface of the guide portion 8 and was grounded. The sheet member guide plate 52 was disposed above the guide portion 8, and the insulating film 50 was stuck to the lower surface thereof. The insulating film 50 used was made of a PET film having an electric resistance of $10^{16}$ Ω.

Referring next to FIGS. 3 and 4, main portions of the conveyer guide member 10 have sizes as described below. That is, a plate thickness T1= 2 mm, a length T2 in the conveying direction=62 mm, a length T3 in a direction at right angles with the conveying direction=226 mm, a length T4 of the ribs 38 and 39 in the conveying direction=66 mm, a length T5 of the ribs 38 and 39 protruding from the downstream end of the conveyer guide member 10=3 mm, a height T6 from the lower end of the conveyer guide member 10 to the vertex at the downstream end of the ribs 38=26 mm, a height T7 from the lower end of the conveyer guide member 10 to the vertex at the upstream end of the ribs 38=32 mm, a height T8 of the ribs 38 at the downstream end thereof=2 mm, and a height T9 of the ribs 38 at the upstream end thereof=5 mm.

Next, main portions of the grounding plate member 30 have sizes as described below. That is, a plate thickness T10=0.8 mm, a length T11 in the conveying direction=40 mm, and a length T12 in a direction at right angles with the conveying direction=220 mm. In a state where the grounding plate member 30 was mounted on the lower surface of the guide portion 8, the distance T13 was 4 mm between the upper surface of the grounding plate member 30 and the vertex of the ribs 38.

Though not illustrated, the thickness of the insulating film 50 was 0.188 mm, the distance between the insulating film 50 and the vertex at the upstream end of the ribs 38 was 9 mm in the vertical direction, and the distance between the insulating film 50 and the vertex of the ribs 38 on the downstream side thereof was 15 mm in the vertical direction.

Moreover, though not illustrated, other main members possessed sizes as described below. That is, the diameter of the photosensitive drum 4= 30 mm, its length in the axial direction=225 mm, the diameter of the transfer roller 16=14 mm, its length in the axial direction=215 mm, the diameter of the heat roller 24 in the fixing unit 6=20 mm, its length in the axial direction=272 mm, the diameter of the press roller 26=18 mm, its length in the axial direction=263 mm, the horizontal distance between the axis of the photosensitive drum 4 and the axis of the heat roller 24=90 mm.

In this Example 1, the following three kinds of plain papers were used each having an electric resistance of $10^{13}$ Ω as mentioned above.

(1) Plain paper of a size A4 specified under JIS (64 g/m$^2$), manufactured by Nippon Seishi Co., trade name "MSK".

(2) Plain paper of a size of 297 mm×210 mm (the same size as the above size A4) (80 g/m$^2$), widely distributed in European countries under the trade name, Neusiedler.

(3) Plain paper of a size of 11 inches×8.5 inches (75 g/m$^2$) which is a letter size paper widely distributed in the U.S.A. under the trade name, Nekoosa.

Experiments were carried out to execute the step of forming image on these papers. The papers were conveyed in their longitudinal direction (conveyed in their lengthwise direction). The separating performance, conveying performance and toner scattering were examined while executing the step of forming an image. The experiments were once interrupted at a moment when any defect was observed during the step of forming an image, and the same experiment was repeated after the content of the defect was confirmed.

According to Example 1, the plain papers onto which the toner had been transferred were all reliably separated without being attracted or taken up by the photosensitive drum 4. There was found no phenomenon in which the plain papers floated upwards in the step in which they were conveyed on the ribs 38 and 39 of the guide portion 8, and it was confirmed that the papers had been conveyed smoothly and reliably along the upper surface thereof. It was confirmed that the image on the plain papers after fixing was vivid, no stain was found on the paper surfaces and the toner had not been scattered at all. That is, according to the apparatus 2 for conveying sheet members of the form employed in Example 1, there was no problem (defect) in regard to the separating performance, conveying performance and toner scattering, and there were obtained results that were sufficiently satisfactory for practical use. The results of the Example 1 are shown in Table 1.

EXAMPLE 2

Example 2 was carried out by using the same apparatus 2 for conveying sheet members as the one used in Example 1 above, but without using the sheet member guide plate 52 and insulating film 50. In other respects, Example 2 was the same as the above-mentioned Example 1, and its details are not repeated here.

According to Example 2, very excellent results which were substantially the same as those of Example 1 were obtained with respect to the separating performance, conveying performance and toner scattering. The contents were as described in Example 1 above and are not repeated here. The results of the Example 2 are shown in Table 1.

EXAMPLE 3

Example 3 was carried out by using the same apparatus 2 for conveying sheet members as the one used in Example 1 above, but without using the sheet member guide plate 52, insulating film 50, and ribs 38 and 39 of the conveyer guide member 10. That is, openings 40 were simply formed in the guide portion 8 of the conveyer guide member 10. The grounding plate member 30 was mounted in the same manner as mentioned above. In other respects, Example 3 was the same as the above-mentioned Example 1, and its details are not repeated here.

According to Example 3, very excellent results which were substantially the same as those of Examples 1 and 2 were obtained with respect to the separating performance, conveying performance and toner scattering. The contents were as described in Example 1 above and are not repeated here. The results of the Example 3 are shown in Table 1.

EXAMPLE 4

Example 4 was carried out by using the same apparatus 2 for conveying sheet members as the one used in Example 1 above, but without using the sheet member guide plate 52, insulating film 50, and ribs 38, 39 and openings 40 of the conveyer guide member 10. That is, the guide portion 8 of the conveyer guide member 10 possessed none of the ribs 38, 39 or openings 40, and the upper surface of the guide portion 8 was simply constituted by the horizontal portion 32, tilted portion 34 and horizontal portion 36 only. The grounding plate member 30 was mounted in the same manner as mentioned above. In other respects, Example 3 was the same as the above-mentioned Example 1, and its details are not repeated here.

In Example 4, the plain paper after the toner had been transferred thereon exhibited a tendency in which it was separated after taken up by the photosensitive drum. However, the amount of take-up was so small that no jam occurred and there was practically no problem. In a step in which the plain paper was conveyed on the guide portion 8, furthermore, a phenomenon was sometimes observed in which the paper upwardly floated depending upon the kind of the plain paper. However, the frequency was small, and it was confirmed that the plain papers had been smoothly conveyed in the step of forming image. In this respect, therefore, there was no problem in practice. On the other hand, a phenomenon was sometimes observed in which the toner sporadically and locally scattered while the plain paper was passing over the guide portion 8. However, the frequency was small and the degree of scattering was small, and hence, there was no problem in practice. In most cases, it was confirmed that the image on the plain paper after fixed was vivid, no stain was found on the paper surfaces and the toner had not been scattered at all. That is, according to the apparatus 2 for conveying sheet members of the form used in Example 4, there was almost no problem with respect to the separating performance, conveying performance and toner scattering, and there were obtained practically satisfactory results. The results of the Example 4 are shown in Table 1.

EXAMPLE 5

Example 5 was carried out by using the same apparatus 2 for conveying sheet members as the one used in Example 1 above, but without using the grounding plate member 30, ribs 38, 39 and openings 40 of the conveyer guide member 10. That is, the guide portion 8 of the conveyer guide member 10 possessed none of the ribs 38, 39 or openings 40, and the upper surface of the guide portion 8 was simply constituted by the horizontal portion 32, tilted portion 34 and horizontal portion 36 only. No grounding plate member 30 was mounted on the lower surface of the guide portion 8. However, the sheet member guide plate 52 and the insulating film 50 were disposed above the guide portion 8. In Example 5, the distance between the insulating film 50 and the upper surface on the upstream side of the guide portion 8 (upper surface of the horizontal portion 32) was 14 mm in the vertical direction, and the distance between the insulating film 50 and the upper surface on the downstream side of the guide portion 8 (upper surface of the horizontal portion 36) was 17 mm in the vertical direction. In other respects, Example 5 was the same as the above-mentioned Example 1, and its description is not repeated here.

According to Example 5, very excellent results were obtained with respect to the separating performance that was substantially equal to that of the aforementioned Examples 1 to 3. The contents were the same as those mentioned in Example 1 and are not described here. With respect to the conveying performance and toner scattering, there was observed the same phenomenon as that of Example 4. The contents were the same as those of Example 4 and are not repeated here. That is, according to the apparatus 2 for conveying sheet materials of the form used in Example 5, there was no problem (defect) in regard to the separating performance, and there were obtained the results that were practically satisfactory to a sufficient degree. And there was almost no problem with respect to the conveying performance and toner scattering, and there were obtained practically satisfactory results. The results of the Example 5 are shown in Table 1.

Comparative Example 1

Comparative Example 1 was carried out by using the same apparatus 2 for conveying sheet members as the one used in Example 1 above, but without using the sheet member guide plate 52, insulating film 50, ribs 38, 39 and openings 40 of the conveyer guide member 10, and the grounding plate member (apparatus that pertains to the prior art). That is, the guide portion 8 of the conveyer guide member 10 possessed none of the ribs 38, 39 or openings 40, and the upper surface of the guide portion 8 was simply constituted by the horizontal portion 32, tilted portion 34 and horizontal portion 36 only. The grounding plate member 30 was not mounted on the lower surface of the guide portion 8. Moreover, neither the sheet member guide plate 52 nor the insulating film 50 was disposed above the guide portion 8. In other respects, Comparative Example 1 was the same as the above-mentioned Example 1, and its description is not repeated here.

According to Comparative Example 1, the phenomenon was frequently observed in which the plain paper onto which the toner has been transferred was taken up by the photosensitive drum 4 after the step of forming image was repeated 50 to 100 times. As a result, most of the plain papers that were taken up were not separated from the photosensitive drum 4 resulting in the occurrence of jamming. After the step of forming image was repeated 50 to 100 times, the phenomenon was frequently observed in which the plain paper floated on the guide portion 8. Moreover, though not so frequently, scattering of the toner was observed on the whole surface or at the front end only of the plain paper. That is, according to the apparatus 2 for conveying sheet members of the above-mentioned form used in Comparative Example 1, defects were observed with respect to the separating performance, conveying performance and toner scattering, arising problems from the practical point of view. The results of Comparative Example 1 are shown in Table 1.

Comparative Example 2

Comparative Example 2 was carried out by using the same apparatus 2 for conveying sheet members as the one used in Comparative Example 1 above, but using the conveyer guide member 10 that was formed by using an ABS resin having an electric resistance of $10^{16}$ Ω. In other respects, Comparative Example 2 was the same as the above-mentioned Example 1, and its description is not repeated here.

According to Comparative Example 2, the phenomenon was frequently observed in which the plain paper onto which the toner has been transferred was taken up by the photosensitive drum 4 after the step of forming an image was repeated 5 to 6 times. Most of the plain papers that were taken up were not separated from the photosensitive drum 4 resulting in the occurrence of jamming. After the step of forming an image was repeated 5 to 6 times, the phenomenon was frequently observed in which the plain paper floated on the guide portion 8. Moreover, the number of times of occurrence of the toner scattering increased with an increase in the number of pieces of the papers that were passed, and the degree of toner scattering became increasingly serious. That is, according to the apparatus 2 for conveying sheet members of the above-mentioned form used in Comparative Example 2, relatively significant defects were observed with respect to the separating performance, conveying performance and toner scattering, and it was confirmed that the apparatus was not practicable. The results of Comparative Example 2 are shown in Table 1 below.

TABLE 1

| | Separating performance | Conveying performance | Toner scattering |
|---|---|---|---|
| Example 1 | ◎ | ◎ | ◎ |
| Example 2 | ◎ | ◎ | ◎ |
| Example 3 | ◎ | ◎ | ◎ |
| Example 4 | ○ | ○ | ○ |
| Example 5 | ◎ | ◎ | ◎ |
| Comparative Example 1 | Δ | Δ | Δ |
| Comparative Example 2 | X | X | X |

◎: Experimental results are very excellent and there is no problem in practice.
○: Experimental results are excellent and there is practically no problem.
Δ: Experimental results are relatively poor and there is problem in practice.
X: Experimental results are poor and there is no practicability.

The following effects are accomplished by the apparatus for conveying sheet members of the present invention that was explained above by way of Examples.

(1) The conveyer guide member has an electric resistance not smaller than the electric resistance of the sheet member, and the electric charge is suppressed from abruptly migrating from the sheet member onto the surface of the guide portion of the conveyer guide member. As a result, the toner on the sheet member is prevented from scattering when the sheet member comes into contact with the surface of the guide portion, and a vivid image is guaranteed.

(2) Since on the lower surface side of the guide portion is disposed the grounding plate member having an electric resistance smaller than the electric resistance of the conveyer guide member, the surface of the guide portion of the conveyer guide member is prevented from being excessively charged with electric charge from the sheet member. As a result, the sheet member is not repelled by the conveyer guide member, and is favorably separated from the photosensitive drum and is conveyed along the guide portion. Moreover, the toner on the sheet member is reliably prevented from scattering either while the sheet member is moving on the surface of the guide portion or when the sheet member separated from the guide portion comes into contact with a metal portion (guide plate, heat roller, etc.) of the fixing unit.

(3) When the grounding plate member is disposed with its upper surface in contact with the lower surface of the guide portion, the dielectric effect becomes high between the lower surface of the guide portion and the upper surface of the grounding plate member, and consequently, there is more reliably obtained the effect for preventing the sheet member from being excessively charged.

(4) When the grounding plate member is made of a metal material, the sheet member is more effectively attracted and is hardly taken up by the photosensitive drum, making it possible to obtain improved separating performance and stabilized conveying performance.

(5) When the grounding plate member is grounded, the discharging function is further improved, and hence, excess charging is prevented more reliably.

(6) When a plurality of openings are formed in the guide portion permitting the upper surface of the grounding plate member to be exposed to the upper surface side of the guide portion through the openings, the sheet member is attracted more strongly making it possible to obtain excellent separating performance and stable conveying performance.

(7) When there are formed, on at least the upstream end portion of the guide portion, a plurality of ribs that are protruded upwardly, and extended in the direction of conveying the sheet member and are arranged, spaced from each other, in a direction at right angles with the conveying direction, the electrostatic repulsion between the sheet member and the surface of the guide member decreases and the separating performance is improved even when the sheet member comes close to, or in contact with, the guide portion i.e. the ribs. When the ribs are formed in addition to the above plurality of openings, the aforementioned effects are obtained and, besides, the sheet member can be smoothly conveyed without coming into contact with the grounding plate member through the openings. Moreover, the electric charge of the sheet member is prevented from leaking to the grounding plate member. Since the contacting portion decreases between the sheet member and the guide portion, the repulsion due to the migration of electric charge decreases and the sheet member is favorably separated.

(8) When the ribs are so formed that they become high toward the upstream side and low toward the downstream side, the sheet member can be stably conveyed on the downstream side.

(9) When the insulating member is disposed above the guide portion while maintaining a distance with respect to, and extending along, the guide portion, the insulating member is electrically charged to the same polarity as that of the electric charge of the sheet member and hence a repulsion is produced between the two. As a result, performance for separating the sheet member is particularly enhanced and conveying performance is stabilized. The above-mentioned effects are obtained even when the grounding plate is not disposed on the lower surface side of the guide portion. Besides, the toner is prevented from scattering.

(10) When a sheet member guide plate is disposed above the guide portion while maintaining a distance with respect to, and extending along, the guide portion and when an insulating member made of an insulating film is stuck to the lower surface that is facing the guide portion, of the sheet member guide plate, there is no need of providing any particular support means for mounting the insulating member, and hence, the cost can be decreased.

Though the present invention was described above in detail by way of Examples, it should be noted that the invention is in no way limited to the above Examples only but can be changed or modified in a variety of other ways without departing from the scope of the invention.

What we claim is:

1. An apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position toward said fixing unit along the upper surface thereof, wherein a grounding plate member is disposed on the lower surface side of said guide portion of said conveyor guide member so as to extend along said guide portion, said conveyor guide member is made of a material having an electric resistance not smaller than the electric resistance of said sheet member, and said grounding plate member is made of a material having an electric resistance smaller than said electric resistance of said conveyer guide member, and wherein a plurality of openings are formed in said guide portion of said conveyer guide member, and the upper surface of said grounding plate member is exposed to the upper surface side of said guide portion through said openings.

2. An apparatus for conveying sheet members according to claim 1, wherein said conveyer guide member is made of a material having an electric resistance of from $10^{13}$ Ω to $10^{16}$ Ω which is not smaller than the electric resistance of said sheet member, and said grounding plate member is made of a material having an electric resistance which is smaller than $10^{13}$ Ω.

3. An apparatus for conveying sheet members according to claim 1, wherein said grounding plate member is disposed with its upper surface in contact with the lower surface of said guide portion of said conveyer guide member.

4. An apparatus for conveying sheet members according to claim 1, wherein said grounding plate member is constituted by a metal material.

5. An apparatus for conveying sheet members according to claim 1, wherein said grounding plate member is grounded.

6. An apparatus for conveying sheet members according to claim 1, wherein on at least the upstream end portion of said guide portion of said conveyer guide member are formed a plurality of ribs that are upwardly protruded, are extended in the direction of conveying the sheet members, and are arranged, spaced from each other, in a direction at right angles with said conveying direction.

7. An apparatus for conveying sheet members according to claim 1, wherein an insulating member is disposed above said guide portion of said conveyer guide member while maintaining a distance with respect to, and extending along, said guide portion.

8. An apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position toward said fixing unit along the upper surface thereof, wherein a grounding plate member is disposed on the lower surface side of said guide portion of said conveyer guide member so as to extend along said guide portion, said conveyer guide member is made of a material having an electric resistance not smaller than the electric resistance of said sheet member, and said grounding plate member is made of a material having an electric resistance smaller than said electric resistance of said conveyer guide member, and wherein on at least an upstream end portion of said guide portion of said conveyer guide member are formed a plurality of ribs that are upwardly protruded, are extended in the direction of conveying the sheet members, and are arranged, spaced from each other, in a direction at right angles with said conveying direction.

9. An apparatus for conveying sheet members according to claim 8, wherein a plurality of openings are formed in said guide portion of said conveyer guide member, and the upper surface of said grounding plate member is exposed to the upper surface side of said guide portion through said openings.

10. An apparatus for conveying sheet members according to claim 8, wherein said ribs have a height that becomes high toward the upstream side and low toward the downstream side.

11. An apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position toward said fixing unit along the upper surface thereof, wherein a grounding plate member is disposed on the lower surface side of said guide portion of said conveyer guide member so as to extend along said guide portion and to come with the upper surface thereof into contact with the lower surface of said guide portion, said conveyer guide member is made of a material having an electric resistance of from $10^{13}$ Ω to $10^{16}$ Ω which is not smaller than the electric resistance of said sheet member, and said grounding plate member is made of a metal material having an electric resistance of not larger than $10^{3}$ Ω, and wherein a plurality of openings are formed in said guide portion of said conveyer guide member, and the upper surface of said grounding plate member is exposed to the upper surface side of said guide portion through said openings.

12. An apparatus for conveying sheet members according to claim 11, wherein on said guide portion of said conveyer guide member are formed a plurality of ribs that are upwardly protruded, are extended in the direction of conveying the sheet members, and are arranged, spaced from each other, in a direction at right angles with said conveying direction, and the height of said ribs become high toward the upstream side and low toward the downstream side.

13. An apparatus for conveying sheet members according to claim 12, wherein an insulating member is disposed above said guide portion while maintaining a distance with respect to, and extending along, said guide portion.

14. An apparatus for conveying sheet members according to claim 13, wherein a sheet member guide plate is disposed above said guide portion while maintaining a distance with respect to, and extending along, said guide portion, and said insulating member of an insulating film is stuck to the lower surface that is facing said guide portion, of said sheet member guide plate.

15. An apparatus for conveying sheet members equipped with a conveyer guide member including a guide portion that extends from the downstream side of a toner image-transfer position of a photosensitive drum toward a fixing unit, said guide portion being so constituted as to guide a sheet member conveyed through said toner image-transfer position toward said fixing unit along the upper surface thereof, wherein a grounding plate member is disposed on the lower surface side of said guide portion of said conveyer guide member so as to extend along said guide portion, said conveyer guide member is made of a material having an electric resistance not smaller than the electric resistance of said sheet member, and said grounding plate member is made of material having an electric resistance smaller than said electric resistance of said conveyer guide member, and wherein an insulating member is disposed above said guide portion of said conveyer guide member while maintaining a distance with respect to, and extending along, said guide portion.

16. An apparatus for conveying sheet members according to claim 15, wherein a plurality of openings are formed in said guide portion of said conveyer guide member, and the upper surface of said grounding plate member is exposed to the upper surface side of said guide portion through said openings.

* * * * *